US005190449A

United States Patent [19]

Dose et al.

[11] Patent Number: 5,190,449

[45] Date of Patent: Mar. 2, 1993

[54] MATERIAL FEED TANK FOR SLUDGE PUMPS

[75] Inventors: Rolf Dose, Filderstadt; Hellmut Hurr, Reutlingen; Hartmut Benckert, Leinfelden-Echterdingen, all of Fed. Rep. of Germany

[73] Assignee: Putzmeister-Werk Maschinenfabrik GmbH, Aichtal, Fed. Rep. of Germany

[21] Appl. No.: 598,602

[22] PCT Filed: Mar. 15, 1989

[86] PCT No.: PCT/EP89/00274

§ 371 Date: Oct. 17, 1990

§ 102(e) Date: Oct. 17, 1990

[87] PCT Pub. No.: WO89/10486

PCT Pub. Date: Nov. 2, 1989

[30] Foreign Application Priority Data

Apr. 23, 1988 [DE] Fed. Rep. of Germany ..... 3813758

[51] Int. Cl.[5] ..... F04B 15/02

[52] U.S. Cl. ..... 417/517; 417/532; 417/900; 417/519

[58] Field of Search ..... 417/900, 512, 517, 519, 417/532

[56] References Cited

U.S. PATENT DOCUMENTS

| | | | |
|---|---|---|---|
| 3,588,294 | 6/1971 | Schlecht | 417/532 |
| 3,682,575 | 8/1972 | Guddal | 417/517 |
| 4,437,817 | 3/1984 | Metzelder | 417/507 |
| 4,466,782 | 8/1984 | Hirashima | 417/517 |
| 4,613,290 | 9/1986 | Evenson | 417/517 |
| 5,061,158 | 10/1991 | Egli | 417/519 |

FOREIGN PATENT DOCUMENTS

| | | |
|---|---|---|
| 0043011 | 1/1982 | European Pat. Off. . |
| 2381187 | 9/1978 | France . |
| 1585482 | 3/1991 | United Kingdom . |

*Primary Examiner*—Richard A. Bertsch
*Assistant Examiner*—Peter Korytnyk
*Attorney, Agent, or Firm*—Kenyon & Kenyon

[57] ABSTRACT

A material-feeding container is disclosed for two-cylinder thick-matter pumps having feeding cylinders that open into the container. Inside the container is arranged a switchable guide-tube linked to the feeding line and alternatively movable between the openings of the feeding cylinders. A cleaning and servicing opening that can be closed with a cap provided with an agitator is arranged in each side wall. When the closing cap hinged on the material-feeding container is opened, the agitator pivots out of the container through the servicing opening, making the switchable guide-tube and its wearing parts freely accessible from the outside.

25 Claims, 2 Drawing Sheets

MATERIAL FEED TANK FOR SLUDGE PUMPS

FIELD OF THE INVENTION

The present invention relates to material feed tanks and, in particular, to material feed tanks for sludge pumps, such as two-cylinder sludge pumps.

BACKGROUND INFORMATION

Known material feed tanks for two-cylinder sludge pumps typically comprise: an upwardly facing material supply opening located in a top portion thereof, which is used, for example, for coupling a material supply line thereto; two discharge cylinder orifices extending through a front wall thereof and bordered by a wear steadyrest; a pressure connector extending through the tank wall for coupling a conveyor line thereto; a tube switch supported within the feed tank and coupled to the pressure connector, which can be swivelled alternately in front of the discharge cylinder orifices; and at least one agitator driven by a motor supported on a side wall thereof.

These types of feed tanks are usually cleaned and serviced through the material supply opening located in the top portion thereof. One problem with such feed tanks, however, is that it has proven to be difficult to disassemble and/or assemble the tube switch when servicing the feed tank through the material supply opening. Also, in cases where the feed tank has a supply line directly coupled thereto, the material supply opening is usually only accessible after the supply line is removed.

One attempted solution to this problem has been to provide a material feed tank with a removable rear panel, wherein the pressure connector is coupled to the rear panel. However, one disadvantage with this configuration is that when service is performed, the conveyor line joined to the pressure connector has to be dismantled. Also, in many instances the rear wall is not accessible from the outside of the feed tank.

Cleaning openings have also been provided in the bases of feed tanks, wherein the cleaning openings are sealed with lids. However, such cleaning openings have proven to be difficult to access and, accordingly, are not suited (or any only conditionally suited) for performing maintenance on, for example, the tube switch or an agitator.

It is an object of the present invention, therefore, to provide a feed tank, which is easily accessible for cleaning, maintenance, and repair purposes, even if the feed tank is fixed in a stationary installation and is accessible only through a narrow space. It is also an object of the present invention to provide such a feed tank in which such maintenance can be performed without having to dismantle the material delivery and removal lines coupled thereto.

SUMMARY OF THE INVENTION

The present invention is directed to a feed tank wherein at least one side wall thereof includes a service opening extending therethrough and, at least one portion of a side wall equipped with an agitator is designed as a sealing lid to cover the service opening. Thus, when the sealing lid is opened, the agitator is swung outwardly from the interior of the feed tank, through the respective service opening.

One feed tank of the present invention comprises a first wall including two material discharge openings extending therethrough. A second wall is located on an opposite side of the feed tank relative to the first wall. A tube switch is supported between the first and second walls and is alternately coupled in fluid communication with the discharge openings. A third wall is coupled to the first and second walls and extends therebetween. The third wall includes a first opening extending therethrough. The first opening is adapted to permit access to the interior of the feed tank therethrough for servicing components located within the feed tank.

A first member of the feed tank is adapted to seal the first opening. The first member is pivotally supported from the feed tank to pivot the first member away from the first opening to access the interior of the feed tank, and to pivot the first member toward the first opening to seal the same.

One feed tank of the present invention further comprises a first motor coupled to the first member, and a first drive shaft coupled to the first motor and rotatably driven therefrom. The first drive shaft extends through the first member and is journaled thereto. A first agitator is coupled to the first drive shaft on the interior side of the first member. The first agitator is driven by the first drive shaft to mix the material in the feed tank and feed it towards the discharge openings.

A feed tank of the present invention further comprises a fourth wall coupled to the first and second walls and extending therebetween. The fourth wall is located opposite the third wall and includes a second opening extending therethrough. The second opening is adapted to permit access to the interior of the feed tank therethrough for servicing components located within the feed tank.

A second member of the feed tank is adapted to seal the second opening. The second member is thus pivotally supported from the feed tank to pivot the second member away from the second opening to access the interior of the feed tank therethrough, and to pivot the second member toward the second opening to seal the same.

The feed tank preferably further comprises a second motor coupled to the second member, and a second drive shaft coupled to the second motor, and rotatably driven therefrom. The second drive shaft extends through the second member and is journaled thereto. A second agitator is coupled to the second drive shaft on the interior side of the second member. The second agitator is driven by the second drive shaft to feed the material in the feed tank towards the discharge openings.

Typically, at least one of the side walls of a material feed tank, and often the side wall equipped with an agitator, is relatively freely accessible along its periphery, even in stationary installations that are accessible only through narrow spaces, since the agitator motor is located there and requires maintenance from time to time. Thus, one advantage of the present invention, is that the agitator can be completely exposed for maintenance purposes. Another advantage of the present invention, is that the tube switch can be easily accessed through a service opening without any hindrance and, in indeed, without having to dismantle other components of the feed tank or conveyor lines coupled thereto, as with known feed tanks.

In one apparatus of the present invention, the sealing lid is adapted to swivel about an axis essentially perpendicular to a horizontal axis of the feed tank. For this purpose, the side wall comprising the service opening is preferably oriented in a plane substantially perpendicular to the horizontal axis of the feed tank. Another advantage of the apparatus of the present invention, is that the accessibility to the interior of the feed tank is further improved, since the sealing lid is pivotally mounted to the feed tank by an additional swivel mechanism.

A hydraulic motor is mounted on a flange coupled to the periphery of the sealing lid. The drive shaft of the hydraulic motor, which extends through the lid, is preferably doubly supported therein. The drive shaft in turn supports the agitator on the inside of the lid opposite the hydraulic motor. The agitator is preferably a spiral feed-type agitator, which continually transports the material delivered into the feed tank in the direction of the discharge cylinder orifices. In principle, however, it is also possible to use ordinary paddle agitators. Without having any discharge effect, ordinary paddle agitators typically serve to primarily loosen and, in turn, thoroughly mix the material in the feed tank.

Other details, features and advantages of the apparatus of the present invention will become apparent in view of the following detailed description and drawings taken in connection therewith.

DETAILED DESCRIPTION

Figure 1:
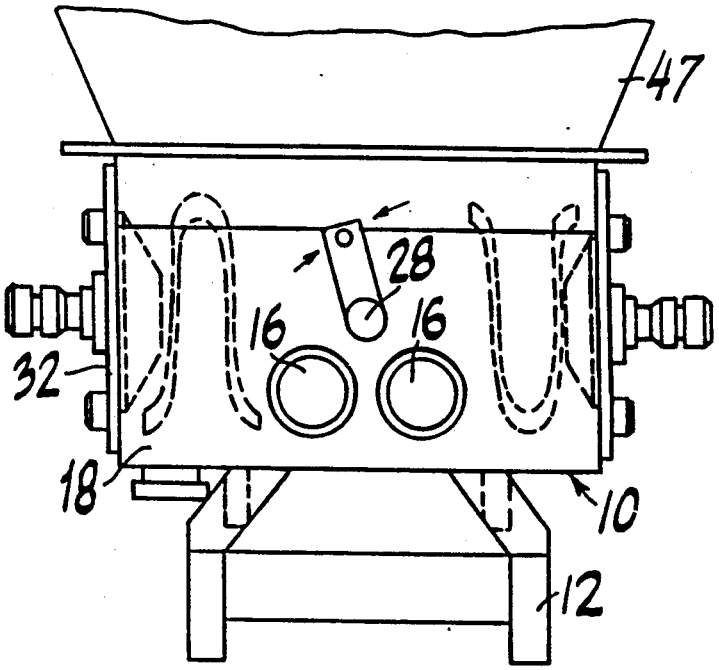
FIG. 1 is a front plan view of a material feed tank embodying the present invention.

In FIG. 1 a material feed tank embodying the present invention is indicated generally by the reference numeral 10. The feed tank 10 is mounted on a pedestal 12 and is coupled to a two-cylinder sludge pump, which includes two discharge cylinders 14. Two discharge cylinder orifices 16 extend through a front wall 18 of the feed tank 10. The discharge cylinders 14 are coupled to the front wall 18 through the discharge cylinder orifices 16. A pressure connector 22 is supported on a pressure flange 46 which is, in turn, supported on a rear wall 20 of the material feed tank 10. The rear wall 20 is located opposite the front wall 18 and oriented substantially parallel thereto. A conveyor line 24 of the sludge pump is coupled to the pressure connector 22, as shown in FIG. 3.

Figure 3:
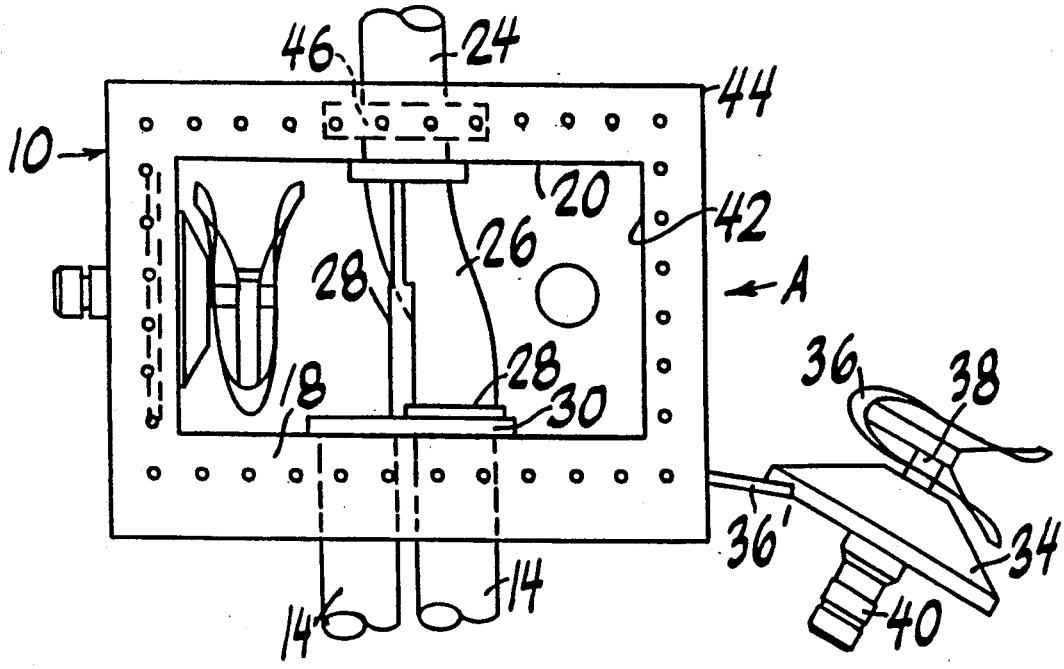
FIG. 3 is a top plan view of the material feed tank of FIGS. 1 and 2, shown with the material filling funnel removed for purposes of illustrating the interior of the feed tank, and with a sealing lid opened for servicing components within the interior of the feed tank.
Figure 4:
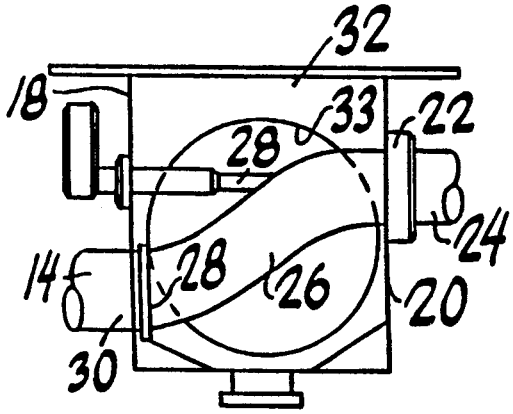
FIG. 4 is a partial side view of the material feed tank of FIGS. 1–3 taken in the direction of the arrow A in FIG. 3.

A tube switch 26 is supported within the feed tank 10 and, as shown in FIGS. 3 and 4, is an S-tube type switch. The tube switch 26 is coupled on one end to the pressure connector 22. The tube switch 26 is supported and adapted to swivel about the axis of a rocking shaft 28, which extends between the front wall 18 and rear wall 20 of the feed tank 10. Thus, the tube switch 26 is adapted to swivel under the power of a hydraulic cylinder (not shown), alternately in front of the two discharge cylinder orifices 16. The tube switch 26 includes a wear ring 28 supported on its end adjacent to the two discharge cylinders 14. The wear ring 28 is movable on a wear steadyrest 30, which is supported on the front wall 18 in front of the discharge cylinder orifices 16.

Figure 2:
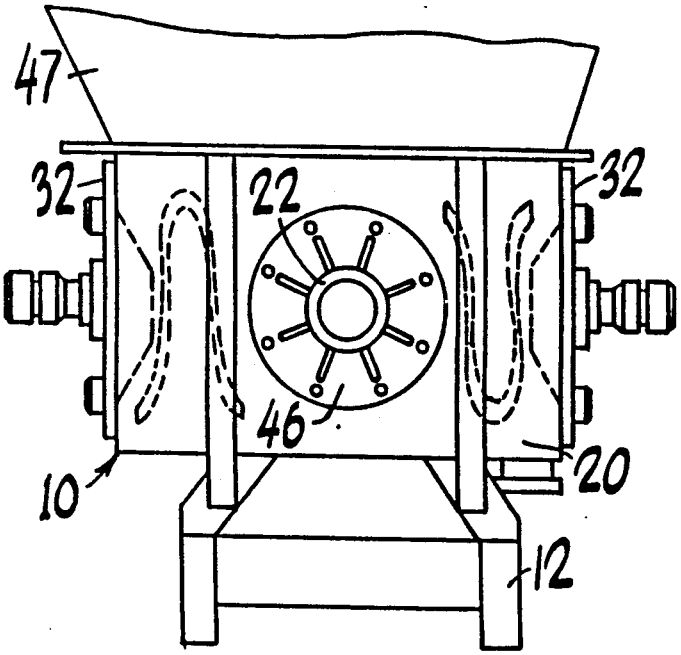
FIG. 2 is a rear plan view of the material feed tank of FIG. 1.

The material feed tank 10 further comprises two side walls 32 oriented in a parallel relationship relative to each other, and each in plane substantially perpendicular to the planes of the front wall 18 and rear wall 20. Each side wall 32 comprises a circular service opening 33 extending therethrough. Each service opening 33 is sealed by a respective sealing lid 34. Each sealing lid 34 is coupled to the material feed tank 10 by a swivel mechanism 36'. Each swivel mechanism 36' is pivotally supported on the feed tank 10, and is adapted to permit the respective sealing lid 34 to be pivoted thereon to open or close the respective service opening 33. As shown in FIG. 2, the swivel mechanism 36' is pivotally coupled to the feed tank 10 at two points, one near the top and the other near the bottom of the respective sealing lid 34.

A pair of agitators 36 are each supported from the interior side of a respective sealing lid 34. Two hydraulic motors 40 are each supported on the exterior side of a respective sealing lid 34. Each hydraulic motor 40 includes a drive shaft 38, which extends through the respective sealing lid 34 and is journaled thereto. Each drive shaft 38 is preferably journaled on at least two points spaced apart from each other in the axial direction thereof within the respective sealing lid 34. Each agitator 36 is coupled to the free end of a respective drive shaft 38, as shown in FIG. 3.

As shown in FIGS. 2 and 3, the feed tank 10 has a substantially rectangular configuration. Thus, the side walls 32 are oriented in a substantially parallel relationship relative to each other, and the front wall 18 is substantially parallel to the rear wall 20. And both the front and rear walls 18 and 20 are substantially perpendicular to the side walls 32. Also, as shown in FIGS. 1 and 2, the hydraulic motors 40 and, thus, the drive shafts 38 are oriented about an axis extending substantially horizontally through the feed tank 10. The swivel mechanisms 36', on the other hand, are each adapted to pivot about an axis substantially perpendicular to the horizontal axis of the feed tank 10.

As shown in FIG. 3, the agitators 36 are spiral feed-type agitators, which can thoroughly mix viscous material contained in the feed tank 10 and, at the same time, feed the material towards the discharge cylinder orifices 16. The feed tank 10 is filled through a material supply opening 42 extending through a top wall thereof. A flange 44 is coupled to the feed tank 10 and located on the periphery of the supply opening 42. A material filling funnel 47 is coupled to the flange 44, and is provided to permit the material to flow therethrough and into the feed tank 10. Alternatively, a material supply line (not shown), can be coupled to the flange 44 to feed the material through the supply opening 42.

When either sealing lid 34 is opened, the respective agitator 36 mounted thereon is pivoted through the servicing opening 33 and, thus, moved from the interior to the exterior of the feed tank 10. Accordingly, each respective agitator 36 can be easily accessed for service by simply opening the respective sealing lid 34. Likewise, the tube switch 26 and the other components of the feed tank 10 that are subject to wear, such as the rocking shaft 28 and wear steadyrest 30, are easily accessible for servicing through one of the service openings 33, by simply opening the respective sealing lid 34.

By detaching the rear pressure flange 46, the tube switch 26 can be disassembled through one or both of the service openings 33 and removed through the rear wall 20 for servicing or replacement with a new tube switch 26. This is particularly applicable for feed tanks in which the bearings (not shown) of the pressure connector 22 are supported within a flange, and the flange must be disassembled from the inside of the feed tank 10 and/or when a separate rocking shaft 28 is provided. Accordingly, the advantages of the feed tank 10 of the present invention, especially with regard to handling the relatively heavy tube switch 26, will become readily apparent to those skilled in the art.

We claim:

1. A feed tank for a sludge pump, comprising:

a front wall including at least two discharge cylinder openings extending therethrough, the discharge cylinder openings being adapted to be alternately coupled in fluid communication with a discharge cylinder of a sludge pump;

a rear wall located opposite the front wall;

a tube switch supported between the front and rear walls;

a first side wall extending between the front and rear walls on one side of the feed tank, and a second side wall extending between the front and rear walls on the other side of the feed tank, at least one of the first and second side walls including a service opening extending therethrough, the service opening being adapted to permit access to the interior of the feed tank therethrough to service the components located therein; and a sliding lid pivotally mounted on the feed tank and adapted to close and, in turn, seal the service opening by being pivoted inwardly toward the respective side wall, and to open the service opening be being pivoted outwardly away from the respective side wall.

2. A feed tank as defined in claim 1, further comprising:

an agitator supported on the interior side of the sealing lid and adapted to feed the material in the feed tank towards the discharge opening in the front wall thereof when the sealing lid is pivoted inwardly to close the service opening, and when the sealing lid is pivoted outwardly to open the service opening, the agitator is, in turn, moved from the interior of the feed tank to the exterior thereof and is thus made accessible for servicing.

3. A feed tank as defined in claim 2, further comprising:

two service openings, one extending through the first side wall and the other extending through the second side wall;

two sealing lids, each sealing lid being pivotally mounted to the feed tank and adapted to close and, in turn, seal a respective service opening; and two agitators, each agitator being supported from the interior side of a respective sealing lid.

4. A feed tank as defined in claim 3, wherein each sealing lid is pivotally mounted about an axis oriented substantially perpendicular to a horizontal axis extending between the first and second side walls.

5. A feed tank as defined in claim 4, wherein the first and second side walls are each oriented in planes substantially perpendicular to a horizontal axis extending therebetween.

6. A feed tank as defined in claim 3, further comprising:

two motors, each motor being supported from the exterior side of a respective sealing lid and including a drive shaft extending through the respective sealing lid and journaled thereto, each drive shaft being coupled to a respective agitator to drive the agitator and, in turn, feed the material in the feed tank towards the discharge openings in the front wall thereof.

7. A feed tank as defined in claim 6, wherein each agitator is a spiral feed-type agitator.

8. A feed tank as defined in claim 1, wherein the tube switch is supported from the rear wall of the feed tank by a pressure connector coupled thereto, and the pressure connector is supported by a flange which is, in turn, coupled to the rear wall and is adapted to be assembled from the interior of the feed tank.

9. A feed tank as defined in claim 8, wherein the tube switch is supported on a rocking shaft and detachable therefrom, and the rocking shaft is, in turn, supported between the front and rear walls of the feed tank.

10. A feed tank as defined in claim 1, wherein the feed tank has a substantially rectangular configuration, such that the front and rear walls are oriented substantially parallel relative to each other, and the first and second side walls are each oriented substantially perpendicular relative to the front and rear walls.

11. A feed tank for a sludge pump, comprising:

a front wall including a material discharge opening extending therethrough;

a rear wall located on an opposite side of the feed tank relative to the front wall;

a tube switch supported between the front and rear walls and coupled in fluid communication with the discharge opening;

a first side wall coupled to the front and rear walls and extending therebetween, the first side wall including a first opening extending therethrough, the first opening being adapted to permit access to the interior of the feed tank therethrough for servicing components of the feed tank located therein; and a first member adapted to seal the first opening, the first member being pivotally supported from the feed tank to pivot the first member away from the first opening to access the interior of the feed tank, and to pivot the first member toward the first opening to seal the same.

12. A feed tank as defined in claim 11, further comprising:

first means for agitating the material located in the interior of the feed tank to feed the material towards the discharge opening, the first means for agitating being coupled to the interior side of the first member and, thus, accessible for servicing by pivoting the first member away from the first opening.

13. A feed tank as defined in claim 12, wherein the first means for agitating comprises:

a first motor coupled to the first member;

a first drive shaft coupled to the first motor and rotatably driven therefrom, the first drive shaft extending through the first member and being journaled thereto; and a first agitator coupled to the first drive shaft on the interior side of the first member, the first agitator being driven by the first drive shaft to feed the material in the feed tank towards the discharge opening.

14. A feed tank as defined in claim 13, further comprising:

a second side wall coupled to the front and rear walls and extending therebetween, the second side wall being located opposite the first side wall and including a second opening extending therethrough, the second opening being adapted to permit access to the interior of the feed tank therethrough for servicing components of the feed tank located therein; and a second member adapted to seal the second opening, the second member being pivotally supported from the feed tank to pivot the second member away from the second opening to access the interior of the feed tank therethrough, and to pivot the second member toward the second opening to seal the same.

15. A feed tank as defined in claim 14, further comprising:

second means for agitating the material located in the interior of the feed tank to feed the material towards the discharge opening, the second means for agitating being coupled to the interior side of the second member and, thus, accessible for servicing by pivoting the second member away from the second opening.

16. A feed tank as defined in claim 15, wherein the second means for agitating comprises:

a second motor coupled to the second member;

a second drive shaft coupled to the second motor and rotatably driven therefrom, the second drive shaft extending through the second member and being journaled thereto; and a second agitator coupled to the second drive shaft on the interior side of the second member, the second agitator being driven by the second drive shaft to feed the material in the feed tank towards the discharge opening.

17. A feed tank as defined in claim 16, wherein the first and second agitators are each spiral feed-type agitators; and the feed tank has a substantially rectangular configuration, such that the front and rear walls are oriented substantially parallel relative to each other, and the first and second side walls are each oriented substantially perpendicular to the front and rear walls.

18. A feed tank for a sludge pump, comprising:

a front wall including a discharge opening formed therethrough;

a rear wall located opposite the front wall;

a switch member supported between the front and rear walls and moveable into fluid communication with the discharge opening;

a first side wall coupled to the front and rear walls and extending therebetween;

a second side wall coupled to the front and rear walls and extending therebetween, the second side wall being located opposite the first side wall; and means coupled to the first side wall for permitting access through said first side wall to the interior of the feed tank for servicing components located therein.

19. A feed tank as defined in claim 16, further comprising means coupled to the second side wall for permitting access therethrough to the interior of the feed tank for servicing components located therein.

20. A feed tank as defined in claim 19, wherein the means coupled to the second side wall for permitting access further includes:

a second opening extending through the second side wall and adapted to permit access therethrough to the interior of the feed tank to service components located therein; and a second sealing lid pivotally supported from the feed tank and adapted to be pivoted toward the second opening to cover and, in turn, seal the same, and adapted to be pivoted away from the second opening to permit access therethrough for servicing components in the interior of the feed tank.

21. A feed tank as defined in claim 20, further comprising:

a first agitator supplied from the interior side of the first sealing lid and adapted to feed the material in the feed tank towards the discharge opening when the first sealing lid is closed; and a second agitator supported from the interior side of the second sealing lid and adapted to feed the material in the feed tank towards the discharge opening when the second sealing lid is closed.

22. A feed tank as defined in claim 21, wherein the first sealing lid is supported from the feed tank by a swivel mechanism including at least two vertical swivel axes.

23. A feed tank as defined in claim 21, wherein the second sealing lid is supported from the feed tank by a swivel mechanism including at least two vertical swivel axes.

24. A feed tank as defined in claim 21, wherein the first and second sealing lids are each supported from the feed tank by a respective swivel mechanism including at least two vertical swivel axes.

25. A feed tank for a sludge pump, comprising:

a front wall including a discharge opening formed therethrough;

a rear wall located opposite the front wall;

a switch member supported between the front and rear walls and moveable into fluid communication with the discharge opening;

a first side wall coupled to the front and rear walls and extending therebetween;

a second side wall coupled to the front and rear walls and extending therebetween, the second side wall being located opposite the first side wall; and means coupled to the first side wall for permitting access therethrough to the interior of the feed tank for servicing components located therein, and wherein the means for permitting access includes a first opening extending through the first side wall and adapted to permit access therethrough to the interior of the feed tank, and a first sealing lid pivotally supported from the feed tank and adapted to be pivoted toward the first opening to cover and, in turn, seal the same, and adapted to be pivoted away from the first opening to access the interior of the feed tank therethrough.

* * * * *

UNITED STATES PATENT AND TRADEMARK OFFICE

CERTIFICATE OF CORRECTION

PATENT NO. : 5,190,449

DATED : March 2, 1993

INVENTOR(S) : Dose et al.

It is certified that error appears in the above-indentified patent and that said Letters Patent is hereby corrected as shown below:

| | |
|---|---|
| Column 1 | line 44, change "any" to --are--; |
| Column 5 | line 29, change "sliding" to --sealing--;<br>line 32, change "be" to --by--; |
| Column 8 | line 3, change "16" to --18--. |

Signed and Sealed this

Twelfth Day of July, 1994

Bruce Lehman

*Attest:*

BRUCE LEHMAN

*Attesting Officer*

*Commissioner of Patents and Trademarks*